US011554901B2

(12) United States Patent
Lesizza et al.

(10) Patent No.: US 11,554,901 B2
(45) Date of Patent: Jan. 17, 2023

(54) PORTABLE STORAGE DEVICE WITH SECURITY AND CLOSURE MECHANISM

(71) Applicants: Scott Lesizza, New York, NY (US); Enlai William Hooi, Copenhagen S (DK)

(72) Inventors: Scott Lesizza, New York, NY (US); Enlai William Hooi, Copenhagen S (DK)

(73) Assignee: Scott Lesizza, New York, NY (US)

( * ) Notice: Subject to any disclaimer, the term of this patent is extended or adjusted under 35 U.S.C. 154(b) by 0 days.

(21) Appl. No.: 17/306,673

(22) Filed: May 3, 2021

(65) Prior Publication Data

US 2021/0339917 A1 Nov. 4, 2021

Related U.S. Application Data

(60) Provisional application No. 63/019,055, filed on May 1, 2020.

(51) Int. Cl.
*B65D 43/02* (2006.01)
*B65D 25/30* (2006.01)

(52) U.S. Cl.
CPC ..... *B65D 43/0214* (2013.01); *B65D 25/30* (2013.01); *B65D 2543/00194* (2013.01)

(58) Field of Classification Search
CPC .... B65D 43/0214; B65D 43/22; B65D 45/28; B65D 23/108; B65D 23/102; B65D 23/104; B65D 25/2835; B65D 25/2838; B65D 25/2841; B65D 25/2844; B65D 25/2847; B65D 25/285; B65D 25/2852; B65D 25/2855; B65D 25/2858; B65D 25/2861; B65D 25/2864; B65D 25/2867; B65D 25/287; B65D 25/2873; B65D 25/2876; B65D 25/32
USPC ..... 220/315, 318
See application file for complete search history.

(56) References Cited

U.S. PATENT DOCUMENTS 3,363,924 A * 1/1968 Remig ..... B65F 1/1615 220/323
4,706,839 A * 11/1987 Spence ..... B65D 45/02 53/421
4,919,888 A * 4/1990 Spence ..... A61L 2/26 422/26
6,352,170 B1 * 3/2002 Brown ..... B65D 55/06 220/792
8,584,894 B1 * 11/2013 Mulvaney ..... A47J 36/10 220/573.1
2004/0065666 A1 * 4/2004 Walker ..... B65F 1/1615 220/318
2008/0169289 A1 * 7/2008 Dawn ..... B65F 1/1615 220/315

(Continued)

*Primary Examiner* — Robert Poon
(74) *Attorney, Agent, or Firm* — Ostrolenk Faber LLP

(57) ABSTRACT

A portable storage container with a lid that is removably positionable on the top of the container body and defines indents or grooves on opposite sides, is described. A strap is secured to opposing side walls of the container body and extends through the side indents to secure the lid on the top of the container body. The top of the container body may also define side indents/grooves that align with the side indents of the lid to provide a snug fit of the strap on top of the lid. The strap may also be moved to a bottom depression or groove on the underside of the bottom of the container body.

11 Claims, 3 Drawing Sheets

(56) References Cited

U.S. PATENT DOCUMENTS

| | | | | |
|---|---|---|---|---|
| 2009/0276982 | A1* | 11/2009 | Nossa | B65D 43/22 24/305 |
| 2013/0081967 | A1* | 4/2013 | Gaul | B65D 5/445 206/386 |
| 2016/0311600 | A1* | 10/2016 | Albert | B65D 25/2841 |

* cited by examiner

PORTABLE STORAGE DEVICE WITH SECURITY AND CLOSURE MECHANISM

CROSS REFERENCE TO RELATED APPLICATIONS

The present application claims priority of U.S. Provisional Application No. 63/019,055, which was filed May 1, 2020, the contents of which are incorporated by reference herein.

FIELD OF THE DISCLOSURE

The present disclosure is in the field of storage bins and carrying cases and, more particularly, of hard containers that are securely closable and portable in an effective and simple manner.

BACKGROUND OF THE INVENTION

Portable storage devices otherwise known as caddies, bins, containers or totes are becoming popular in workplaces, presenting a relatively mobile storage alternative to drawers, cupboards and cabinets. These are typically in the form of rectangular shaped bins, often made of plastic, often of drawer size or larger, that can house papers, laptops, chargers, writing implements, and other office equipment.

Some typical problems with such bins include:

First, such bins need to be carried using two hands, preventing the use of a free hand while transporting the container and its contents. In containers with integrated central handles, such as a tool tray, caddy or tackle-box, a central part of the storage area may be partially occluded, resulting in a container with limited storage utility. A largely open, rectangular storage may be practical in that it maximizes use for file and folder storage and retrieval.

Second, there is a lack of options regarding secure closure of bins in an aesthetically pleasing manner, unless additional locking devices are used. Such devices often are not integrated into the container.

Thirdly, straps that may be used to carry such a bin may separate and may be lost, and such straps, handles or lids may be obtrusive and may serve no purpose most of the time, that is when the bid is not being carried.

Also, lids with integrated handles tend not to have a useful secondary purpose. Lids that are not integrated tend to get lost or set aside and neglected, even if they allow the container to be carried with a single hand.

SUMMARY OF THE DISCLOSURE

Described is a portable storage container, mobile storage system, and means for storage and carrying. A portable container includes:

A container body with a bottom and side walls, the side wall defining a top of the container body; a removable lid, positionable on the top of the container body and its perimeter form defining a first indent or some type of groove on a first side of the lid and a second indent or some type of groove on a second side of the lid opposite the first side; a flexible strap secured to opposing side walls of the container body and securing the lid on the top of the container body, such that the first and second indents or grooves of the lid are configured to receive an entire width of the flexible strap when the flexible strap is positioned on the top surface of the lid so as to secure the lid on the top of the container body.

In such a container, the top perimeter of the container edge may have corresponding indents or some type of grooves to align with those of the lid, such that the flexible strap may be received and positioned in place by the shape of the container edge and/or shape of the lid edge.

The bottom perimeter of the lid may define a depression in its form that cooperates with the shoulder at the top of the container body that received the lid. In addition, a lip of the lid may extend outward in a lateral direction around the perimeter of the lid so that the lip sits on top of the perimeter of the container body while the depression of the lid extends down just inside the top of container body to sit on the shoulder.

Such a portable storage container may also include a pair of swiveling affixers positioned at opposite sides on an outside of the container body and configured to rotate, such that rotation of the affixer mechanisms helps rotate the flexible strap to the underside of the bottom of the container body without inverting the strap, that is the pair of swiveling affixers may facilitate in maintaining the flexible strap in positon without undue twisting. According to an aspect of the disclosure, in this way, a weight of the container would tend not to crush the flexible strap when the flexible strap is positioned inside the depression or groove inside the underside of the bottom of the container body. Such a container body may be substantially rectangular.

Such a portable container may also include a pair of mechanical fasteners to control the release of the releasable strap feature. The lid may thus be secured closed with the strap in a shorter position, wherein the indents of the lid and/or the indents at the top in the sides of the container body may permits the strap to fasten in its shortest position, and alternatively may permit the strap to extend, releasing the lid, optionally being used as a carry-strap. Also, the pair of mechanical fasteners may secure the flexible strap at a given length for the carrying position to suit the preference and height of the person carrying the container. Such a fastener may optionally be locked in the shortest position, comprising a security feature that prevents removal of the lid without disengagement of the locking device. The mechanical fasteners may be buckles or clasps that releasably secure in place the flexible strap at a desired length of the flexible strap, the desired length selected by the user according wo whether the flexible strap is to secure the lid to the container body or to serve as a shoulder strap for carrying the container. According to an aspect of the disclosure, each mechanical fastener may be integrated with and/or comprise the swiveling affixer.

The bottom of the container body may define a bottom groove shaped to receive an entire width of the flexible strap when the flexible strap is positioned under the bottom of the container, and the bottom groove may extend from one edge of the bottom of the container body to a second edge of the bottom of the container body, the second edge being opposite the first edge.

The lid may have a top surface and a lip extending up at the periphery of the lid on all sides of the lip to define a shallow tray on the top surface of the lid, the lip defining the first and second grooves of the lid.

The container body and lid may include or may be made entirely of a stiff but resilient material.

Properties or features described or illustrated with respect to one aspect of the disclosure, or recited with respect to one claim below, may be combined with, or substituted for, one or more properties or features described or illustrated with respect to another aspect of the disclosure, or recited with respect to another claim or portion thereof. Contemplated are many such additional combinations of features, and many such substitutions of features, not explicitly noted or illustrated.

BRIEF DESCRIPTION OF THE DRAWING(S)

Figure 1:
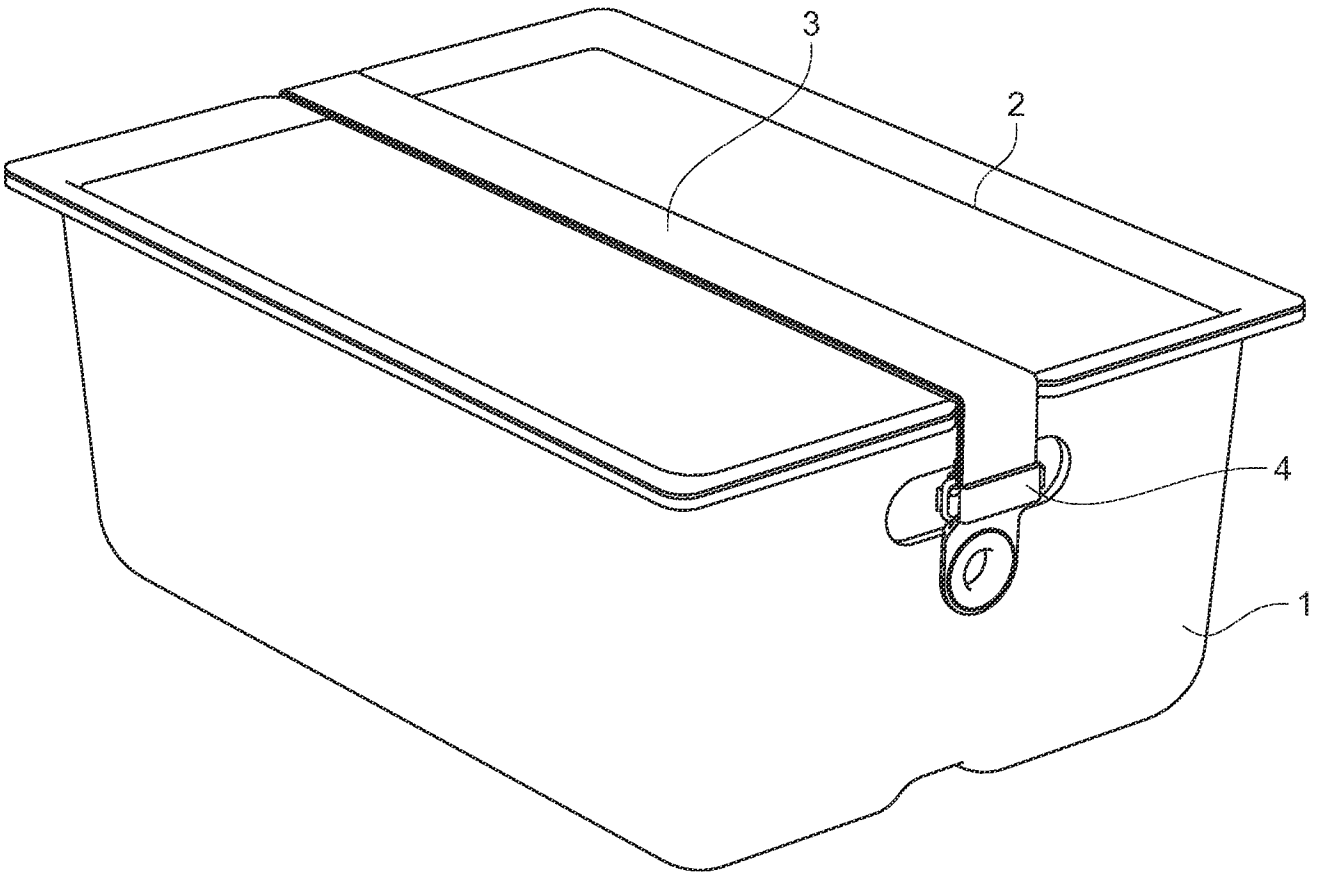
FIG. 1 is a perspective view of a container, including the container body, lid and strap, according to an example of an aspect of the disclosure.

The Drawings illustrate examples of aspects of the invention. Other features and advantages of the present invention will become apparent from the following description of the invention, and/or from the combination of one or more of the figures and the textual description herein, or from portions thereof.

DETAILED DESCRIPTION OF THE INVENTION

According to an aspect of the disclosure, a container is designed with an integrated strap that cannot be removed accidentally when the container is carried using the strap. This strap may be secured to the container in such a way that it forms a carry handle. The strap may be made of a flexible material. The strap may be made to rotate around a pair of swiveling affixers, which may be provided as bezels, one swiveling affixer at each end of the strap so that when not in use the strap is positioned underneath the bottom of the container body. The strap may be doubled back on itself in the shortest position, meaning it may be adjusted to nearly half of its extended length so that it secures the lid on top of the container body. In this way, the strap may serve at least two purposes in its two possible positions: Firstly, the strap may be used in its extended position to carry the container. Secondly, it may be folded over the lid to secure the lid that fits to the form of the open top of the container. According to an aspect of the disclosure, the strap may thus serve as a security device when the strap secures the lid in place on top of the container body and the strap is fixed in place so as to prevent lengthening of the strap with a security device such as a lock. The lock may be integrated with a mechanical fastener, or each mechanical fastener may comprise a lock that prevents release of the strap. In this locked position, with the strap snug around the lid and positioned inside the indents of the lid and/or of the container body as described, and/or positioned inside the depression/groove on the underside of the container body as described, a securely locked container may be attained.

In addition, according to an aspect of the disclosure, the strap may be rotated underneath the bottom of the container while the container is open and being actively used. The container body may have a recess or groove that accommodates the strap to allow the strap to pass underneath the bottom of the container body without contacting a flat surface on which it rests. Indents on opposite sides of the top of the container body and corresponding indents in opposite sides of the lid may also receive the strap in the closed state of the container to achieve a more secure closure. In this state, the strap may be locked in its shortest position, allowing the closed state of the container to be secured. The locking mechanism may serve to secure the strap in its shortest position wherein the lid may not be easily removed due to its perimeter shape which prevents removal without lengthening the strap, requiring it to be unlocked beforehand.

According to an aspect of the disclosure, the form, size or geometry of the storage container may remain substantially the same as conventional plastic bins. At the same time, the top opening of the container body need not be partially obscured by built-in central handle.

The lid may also have a dual role: The lid may be shaped to perform as a shallow tray as a surface on which to organize objects (e.g. on a desk surface). According to this aspect of the disclosure, the lid may have a lip around a periphery that extends up so as to create the shallow tray. In this way, pens or other writing implements, small electronic devices and the like may not roll off the top of the lid as readily. In such a lip, side grooves may be formed on opposite sides of the lid to receive the strap and thus to allow tighter positioning of the strap on top of the lid.

Also, according to a further aspect of the disclosure, the lid may serve similarly to common service trays that exist in the home and hospitality industries. The lid may be used in this way on its own and/or the lid may be integrated into storage system with the lid. This dual-purpose of the lid reduces the likelihood of the lid being set aside and lost.

According to an aspect of the disclosure a drawer-sized container may be carried in one hand, without compromising the general form of the storage device, that is, without the need for a central permanent handle, and without a handle that is an easily detachable that might become separated or lost in use. The strap same may also serve as a locking device, securing a lid to the container in a novel way. In this way, a drawer-sized container may be closed, and the lid secured to the container body, and a mobile container may be carried with a single hand or over the shoulder without the drawbacks of similar products on the market.

At the same time, according to an aspect of the disclosure, the basic form, size and geometry of the container may be comparable to the large drawer-sized or large drawer-sized bin. The storage area may remain rectangular or substantially rectangular. Substantially rectangular may mean that the container main body provides a footprint that may have somewhat rounded corners to facilitate molding or other steps in the manufacturing process but provides a large nearly rectangular footprint that is readily and conveniently usable for storage of hanging files/folders or for other rectangular, or nearly rectangular, objects such as laptop computers or the like.

The Container May Include:

Container main body 1 that includes a bottom and side walls 12, and a recess or body groove 15 on the underside of the bottom. Container main body 1 may have an upwardly and outwardly protruding upper lip 13 that may extend laterally past the side walls 12. This upper lip 13 may be an extension at the top of all the side walls 12. For example, a single upper lip 13 may extend along an entire perimeter of the top opening of the container main body 1. Indents in the perimeter of the upper lip 17 may be provided on opposing sides of the upper lip 13. Container main body (1) may also have handling slots or apertures 7 to facilitate moving, particularly if the strap is located on the underside of the main container.

Figure 2:
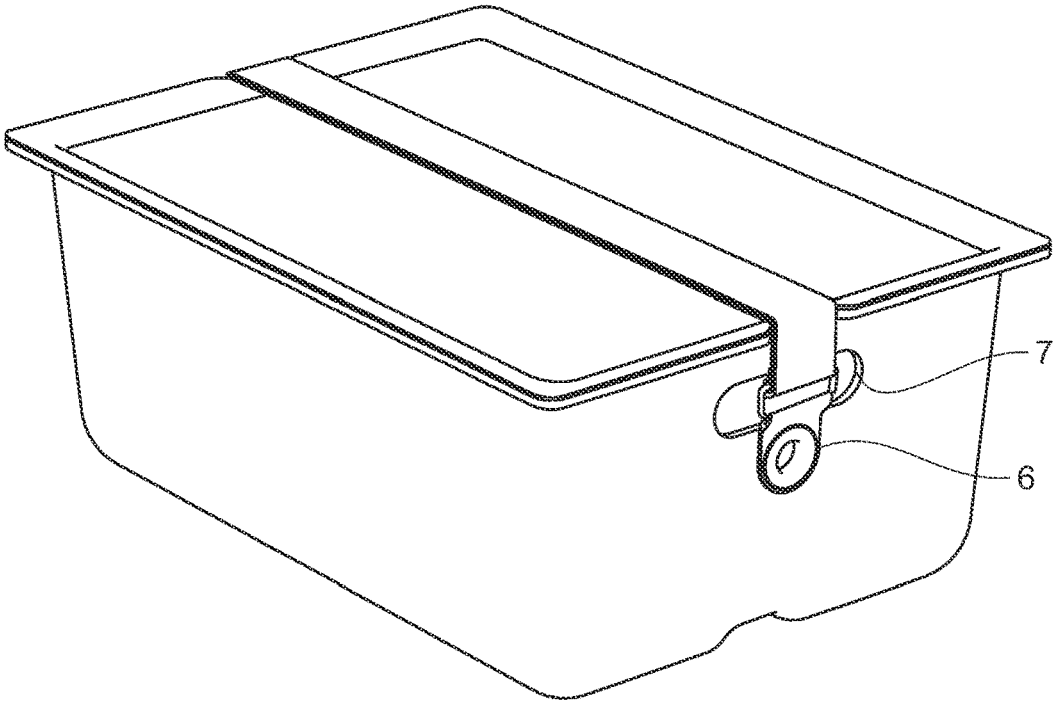
FIG. 2 is an illustration of the container in the closed position with the strap securing the lid on top of the container body, according to an example of an aspect of the disclosure.
Figure 3:
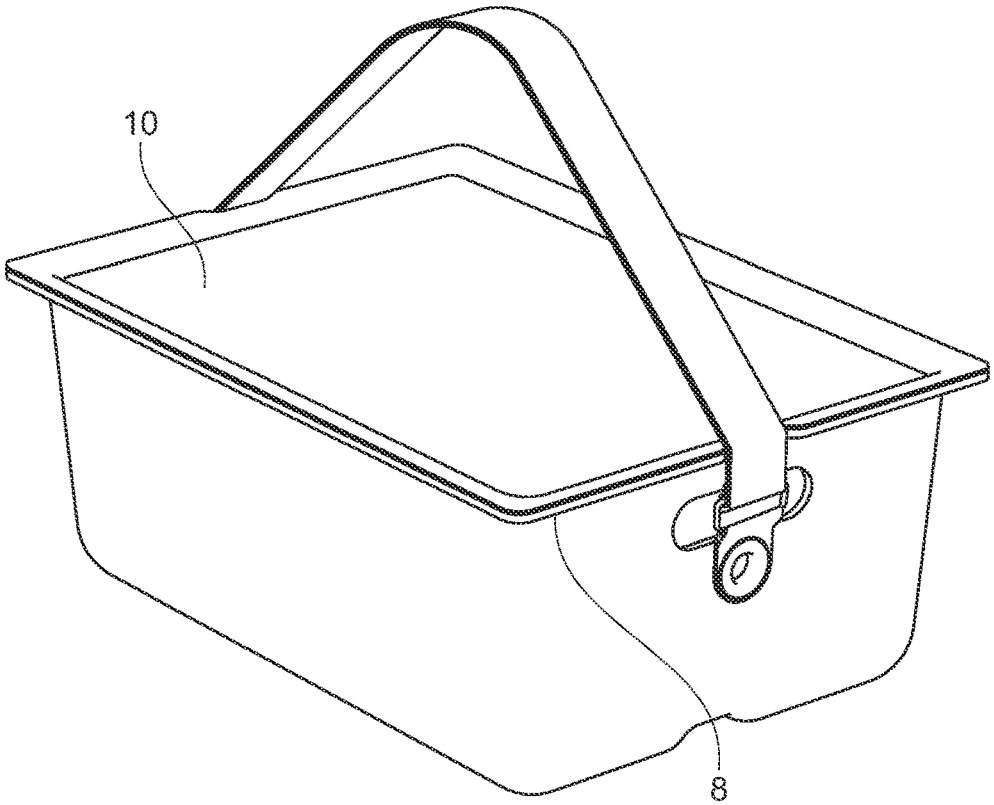
FIG. 3 is an illustration of the container in the closed position with the strap in the longer deployment in the carrying position, according to an example of an aspect of the disclosure.
Figure 4:
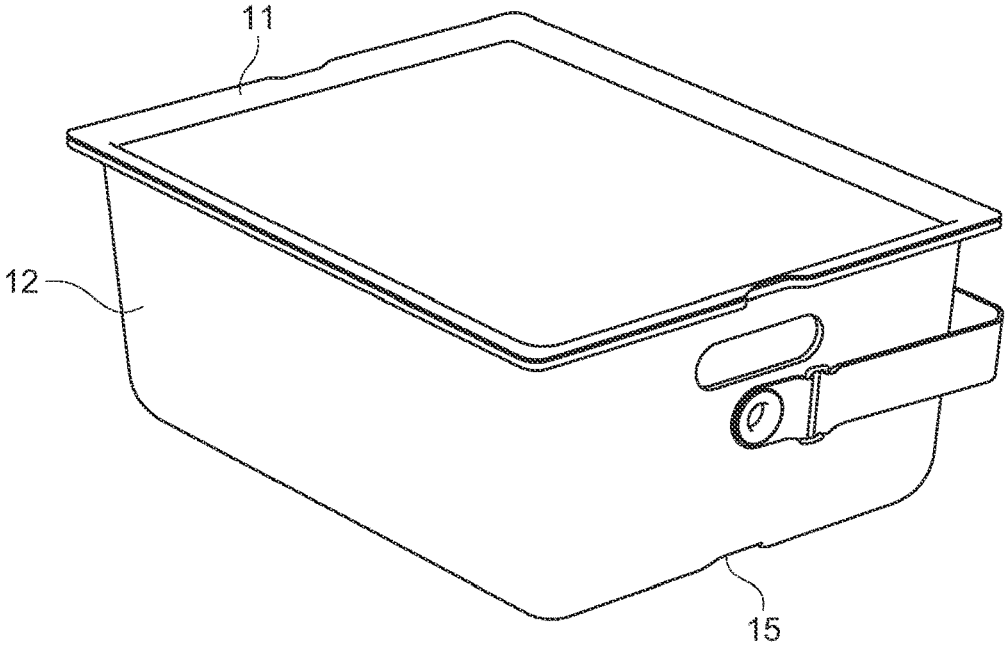
FIG. 4 is an illustration of the container in the closed position with the strap rotated to a side, according to an example of an aspect of the disclosure.

Lid 2 formed with a lip 8 that may extend up and laterally past side walls 12 of container main body 1 when the lid 2 is in position at the top of the container body 1, and may have a similar profile to lip 13 of container main body 1. Both the lid 2 perimeter and lip 8 may have indents 11 on opposite sides that are shaped and sized to receive the strap 3. Each indent 11, of lid 2 may align with indent 17 of container main body 1 when the lid 2 is in position at the top of container main body 1. Each indent 11 of lid 2 and each indent 17 of container main body 1 may be positioned and sized to receive an entire width of strap 3 so as to assist in holding strap 3 in place. This may be true when the strap 3 is tightened to secure lid 2 on container main body 1 as illustrated in FIG. 2, to achieve a snugger fit around the lid 2. Such positioning of strap 3 may also exist when the strap 3 is loosened to the carrying position shown in FIG. 3 so as to reduce slipping and sliding of the strap and to reduce shaking of the container and its contents when a person walks with the strap 3 over his or her shoulder. Accommodating or receiving an entire width of the strap 3 in the grooves may mean that the side grooves 11 and 17 are wide enough to receive strap 3 as a length of strap 3 traverses them, as shown in FIG. 2 with respect to grooves 11 and 17, and as shown only with respect to grooves 17 of container body 1 in FIG. 3. It may also mean that the side grooves 11 and 17 are sufficiently wide to receive strap 3 but not so wide that strap 3 readily moves from side to side inside the side grooves 11 and 17.

Figure 5:
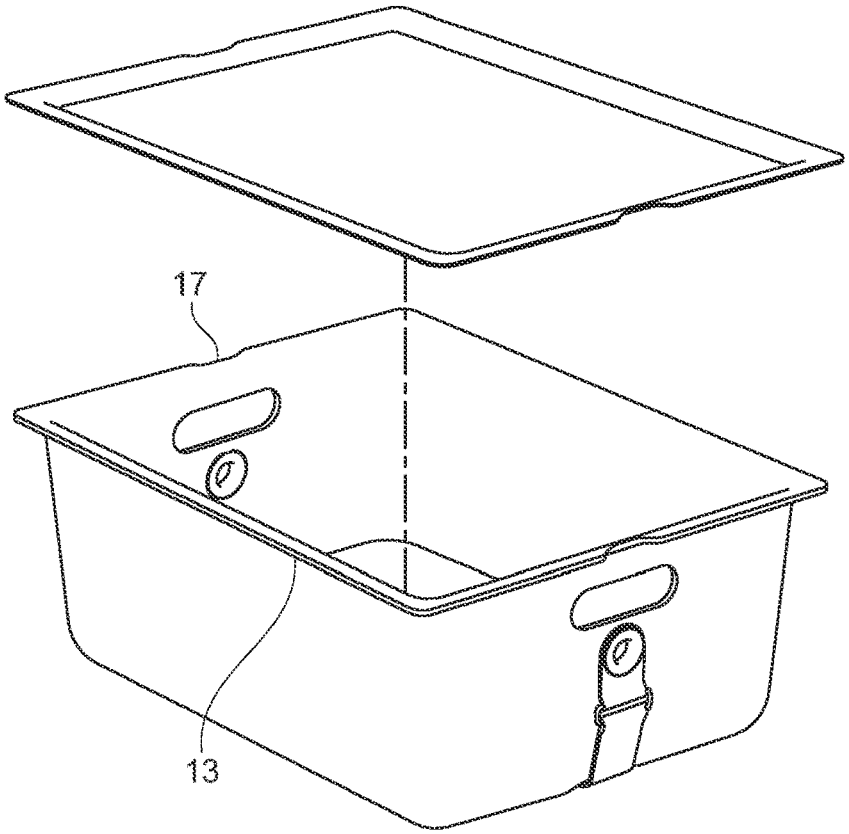
FIG. 5 is an illustration of the container in the open position with the strap positioned underneath the container body in a bottom groove of the container body, according to an example of an aspect of the disclosure.

Strap 3 attached or attachable to the container main body, possibly at swiveling affixers or rotating bezels 6 positioned at opposite sides of the container main body. Swiveling affixers or bezels 6 may rotate together with strap 3 to position strap 3 away from the top of storage container main body 1 and to move strap 3 to underneath container body 1 as shown in FIG. 5.

Mechanical strap connector 4 that can be used to tighten the strap 3 to secure the lid 2 on the open top of the container maid body 1 or to loosen the strap 3 to release the lid 2, for example, when a greater length for the strap 3 is needed for carrying the container.

The container main body 1 and the lid 2 may be made from resilient material, such as a hard or firm plastic. Such a material may maintain its shape and feels rigid when pressed, when files or folders are hanged inside the container main body 1, or when a person uses the lid 2 as a shallow tray for writing or as a tabletop on which to use a laptop computer. At the same time, such a material may be resilient enough that when a person presses the lid 2 onto the top of the container body 1, there is a slight elastic deformation around the edges to facilitate a sealed closing of the lid 2 on the container body 1. Container body 1 and lid 2 may be molded thermoformed, punched, injection-molded or deep-drawn into their forms and subsequently trimmed to achieve the appropriate edge condition and apertures that allow them to be carried and fastened. The material of said container body 1 and lid 2 may need to be resilient enough to carry loads appropriate to the size of the container. The example presented uses molded PET nonwoven fibers, however these could be made of thermoset polymers, thermoplastic polymers or ductile metals. While described herein sometimes as plastic, it will be understood that other materials, such as felt or metal, for example, steel, aluminum, or metal allows, may be used for part or all of the lid 2 and/or the container body 1, or a combination of such or other materials may be used for the lid 2 and/or for the container body 1. For example, the lid 2 may be made of metal while container body 1 may be made of plastic.

Adjustable strap 3 may be made of a flexible material that can be wrapped around lid 2 or wrapped around a bottom of the container body 1. Mechanical fastener 4 may be provided to enable the strap to be tightened or loosened. Removable lid 2 may thus be secured by the strap 3 and optionally locked in place or alternatively, the strap may be secured beneath the container. The adjusted length of the strap 3 when secured beneath the container in the bottom groove 15 may be substantially equivalent to when strap 3 secures lid 2 to the top of the container body 1. Strap 2 may be made of flexible material that is resilient in tension such as leather, webbing, textile, or plastic, or a combination of the foregoing, secured mechanically to the container body 1. Strap 2 may provide a level of adjustability to allow it to both secure a lid 2 to the top of the container body 1 in its shortened position and also to extend to a length sufficient to pass strap 3 around the container to the underside, whereupon said strap 3 may be shortened to fit into a bottom groove 15 located on the underside of container body 1. According to an aspect of the disclosure, strap 3 may be detachable either on one side or both sides of the container body 1. In this case, the handle could be made of either flexible material or stiff material.

Outer flanges of lips 8 and 13 of container body 1 and lid 2, respectively, may be shaped to allow both elements together, and each element individually, to act as sliding drawer-like features using slots or rails in cabinetry and furniture to guide their movement. The flanges may be produced integrally to the molding or forming process of the parts.

The container may be used for the storage, carriage and organization of appropriate goods, tools and objects. A lock (not illustrated) may also be provided. Strap 3 may then be re-tightened so that strap 3 tucks into a groove or recess 15 under the container body 1. In this way, the weight of the container and its contents is not borne by strap 3.

Although the present invention has been described in relation to particular embodiments thereof, many other variations, combinations of features, modifications of features, and relations between structures will become apparent to those skilled in the art. Structures outlined as adjacent need not necessarily be positioned in that way, and not all steps or structures illustrated or described need necessarily be provided. Additional intervening steps or structures may be inserted. Structures described or illustrated as single units or structures may be substituted for by two or more structures, and structures described or illustrated as having multiple parts or divisions may be substituted for by a single structure. Uses and applications are described only by way of illustrative example. It is preferred, therefore, that the present invention not be limited by the specific disclosure herein.

What is claimed is:

1. A portable storage container comprising:

a container body comprising a bottom and side walls, the side wall defining a top of the container body;

an outwardly protruding upper lip at the top of the container body and extending laterally past the side walls;

a lid removably positionable on the top of the container body and defining a first groove on a first side of the lid and a second groove on a second side of the lid opposite the first side;

a flexible strap secured to opposing side walls of the container body and configured to secure the lid on the top of the container body;

a first body side groove that is defined in the upper lip and aligns with the first groove in the lid and is configured to receive an entire width of the flexible strap, and a second body side groove opposite the first body side groove that is defined in the upper lip and aligns with the second groove in the lid and is configured to receive an entire width of the flexible strap;

a bottom groove at the bottom of the container body shaped to receive an entire width of the flexible strap when the flexible strap is positioned under the bottom of the container body, and the bottom groove extends from one edge of the bottom of the container body to a second edge of the bottom of the container body, the second edge being opposite the first edge; and a pair of swiveling affixers positioned at opposite sides outside of the container body and configured to rotate, each swiveling affixer being attached to a respective end of the strap such that rotation of the swiveling affixers moves the flexible strap under the bottom of the container body into the bottom groove and from the bottom groove to top of the lid and inside of the first groove and the second groove of the lid and the first body side groove and the second body side groove;

wherein the first and second grooves of the lid are configured to receive an entire width of the flexible strap when the flexible strap is positioned on the top of the lid to secure the lid on the top of the container body.

2. The portable storage container of claim 1, wherein the container body is substantially rectangular.

3. The portable storage container of claim 1, further comprising a pair of mechanical fasteners, each mechanical fastener configured to releasably tighten the flexible strap.

4. The portable storage container of claim 1, wherein the flexible strap is detachable from the container body.

5. The portable storage container of claim 1, wherein the lid comprises a top surface and a lip extending up at the periphery of the lid on all sides of the lip to define a shallow tray on the top surface of the lid, the lip defining the first and second grooves of the lid.

6. The portable storage container of claim 1, wherein the container body and lid are made of a resilient material.

7. The portable storage container of claim 1, wherein the container body is made of felt.

8. A portable storage container comprising:

a container body comprising a bottom and side walls, the side wall defining a top of the container body;

a lid removably positionable on the top of the container body and defining a first groove on a first side of the lid and a second groove on a second side of the lid opposite the first side;

a flexible strap secured to opposing side walls of the container body and configured to secure the lid on the top of the container body;

a bottom groove at the bottom of the container body shaped to receive an entire width of the flexible strap when the flexible strap is positioned under the bottom of the container body, and the bottom groove extends from one edge of the bottom of the container body to a second edge of the bottom of the container body, the second edge being opposite the first edge; and a pair of swiveling affixers positioned at opposite sides outside of the container body and configured to rotate, each swiveling affixer being attached to a respective end of the strap such that rotation of the swiveling affixers moves the flexible strap under the bottom of the container body into the bottom groove and from the bottom groove to top of the lid and inside of the first groove and the second groove of the lid; and mechanical fasteners configured to releasably tighten the flexible strap, and releasably and selectively secure in place the flexible strap at a desired length;

wherein the first and second grooves of the lid are configured to receive an entire width of the flexible strap when the flexible strap is positioned on the top of the lid to secure the lid on the top of the container body, and wherein the desired length may permit the flexible strap to secure the lid to the container body, to serve as a shoulder strap for carrying the container, or to reside in the bottom groove.

9. The portable storage container of claim 8, wherein the mechanical fasteners are buckles or clasps.

10. The portable storage container of claim 8, further comprising a lock to prevent release of the strap.

11. The portable storage container of claim 8, wherein the container body is made of felt.

* * * * *